US011673727B2

(12) United States Patent
Bloedt

(10) Patent No.: US 11,673,727 B2
(45) Date of Patent: Jun. 13, 2023

(54) DISPENSING SYSTEM FOR A FLEXIBLE BAG, FLEXIBLE BAG ASSEMBLY

(71) Applicant: Scholle IPN Corporation, Northlake, IL (US)

(72) Inventor: Anton Bloedt, Sharpsburg, GA (US)

(73) Assignee: Scholle IPN Corporation, Northlake, IL (US)

( * ) Notice: Subject to any disclaimer, the term of this patent is extended or adjusted under 35 U.S.C. 154(b) by 36 days.

(21) Appl. No.: 17/191,580

(22) Filed: Mar. 3, 2021

(65) Prior Publication Data

US 2022/0281667 A1 Sep. 8, 2022

(51) Int. Cl.

| | |
|---|---|
| ***B65D 47/24*** | (2006.01) |
| ***B65D 75/00*** | (2006.01) |
| ***B65D 75/58*** | (2006.01) |
| ***B67D 3/00*** | (2006.01) |

(52) U.S. Cl.

CPC ..... *B65D 75/5883* (2013.01); *B65D 47/248* (2013.01); *B65D 75/008* (2013.01); *B67D 3/0061* (2013.01); *B67D 3/0067* (2013.01); *B65D 2575/583* (2013.01); *B67D 2210/00047* (2013.01)

(58) Field of Classification Search

CPC ..... B65D 75/5883; B65D 75/008; B65D 2575/583; B67D 2210/00047; B67D 3/0061; B67D 3/0067

See application file for complete search history.

(56) References Cited

U.S. PATENT DOCUMENTS

| | | | | |
|---|---|---|---|---|
| 4,375,864 | A * | 3/1983 | Savage | B65D 77/067 222/499 |
| 4,660,803 | A * | 4/1987 | Johnston | F16L 37/22 285/24 |
| 5,819,986 | A | 10/1998 | Last et al. | |
| 6,126,045 | A | 10/2000 | Last | |
| 6,253,804 | B1 * | 7/2001 | Safabash | A61J 1/2096 604/416 |
| 6,354,473 | B1 * | 3/2002 | Brambach | B65D 47/247 222/523 |

(Continued)

FOREIGN PATENT DOCUMENTS

| | | | |
|---|---|---|---|
| EP | 1006415 | A1 | 2/1999 |
| JP | 2002160753 | A | 6/2002 |

(Continued)

*Primary Examiner* — Frederick C Nicolas

(74) *Attorney, Agent, or Firm* — The Watson IP Group, PLC; Jovan N. Jovanovic

(57) ABSTRACT

A dispensing system for a flexible bag including a spout having a body, a plug and a first and second flexible coupling. The body includes a central bore extending therethrough, with a lower ring wall at a lower end. The plug has a cavity and plug ring wall attachable to the lower ring wall in sealed engagement. The first flexible coupling and the second flexible coupling each being formed from a base web and extending from the lower end of the body. A first arm is coupled to the base web at a first hinge. A second arm is coupled to the first arm opposite the base web at a central hinge. The plug is coupled to the second arm opposite the first arm at a plug hinge. A probe is likewise disclosed that is insertable into a flexible bag, as is a flexible bag assembly and method.

17 Claims, 8 Drawing Sheets

(56) References Cited

U.S. PATENT DOCUMENTS

| | | | | |
|---|---|---|---|---|
| 6,394,992 | B1 * | 5/2002 | Sjoholm | A61M 5/162 604/199 |
| 6,644,367 | B1 * | 11/2003 | Savage | B67D 3/04 141/351 |
| 6,644,519 | B2 * | 11/2003 | Last | B65D 47/36 141/351 |
| 6,871,679 | B2 | 3/2005 | Last | |
| 7,690,528 | B2 * | 4/2010 | Last | B29C 45/006 220/789 |
| 10,526,194 | B2 * | 1/2020 | Van Der Molen | B67D 7/0294 |
| 11,220,379 | B2 * | 1/2022 | Heinbuch | B67D 7/0294 |
| 2004/0045632 | A1 * | 3/2004 | Last | B65D 75/5877 141/383 |
| 2012/0024858 | A1 * | 2/2012 | Sholes | B65D 75/5883 220/367.1 |

FOREIGN PATENT DOCUMENTS

| | | | |
|---|---|---|---|
| WO | 0066448 | A1 | 11/2000 |
| WO | 03031161 | A1 | 4/2003 |
| WO | 2021230234 | A1 | 11/2021 |

* cited by examiner

DISPENSING SYSTEM FOR A FLEXIBLE BAG, FLEXIBLE BAG ASSEMBLY

CROSS-REFERENCE TO RELATED APPLICATION

N/A

BACKGROUND OF THE DISCLOSURE

1. Field of the Disclosure

The disclosure relates in general to a flowable material dispensing, and more particularly, to a dispensing system for a flexible bag. Additionally, a flexible bag assembly having a spout of the present disclosure for use with a probe is disclosed.

2. Background Art

The use of connector assemblies having plugs that can be releasably decoupled from a spout internal to the flexible bag (by, for example, a probe) and then reattached after filling or dispensing has been known in the art. Such spouts allow for filling or dispensing and the closure of the spout prior to removal of a probe.

One such solution is disclosed in U.S. Pat. No. 6,126,045 entitled "Connector Assembly For A Fluid Connection" which issued to Laurens Last and assigned to ITSAC NV. Another such solution is disclosed in U.S. Pat. No. 6,871,679 entitled "Bag And Dispensing System Comprising Such A Bag" which issued to Laurens Last and assigned to IPN IP BV. Each of these patents are incorporated by reference in their entireties in the present application. Each such solution utilizes a probe that is inserted into a spout, whereupon the probe couples to a plug then can dislodge the plug from the spout to permit dispensing or filling through the probe. When completed, the probe reattaches the plug to the spout to seal the same, whereupon the spout can be decoupled from the plug and removed.

While such solutions have been successful there are nevertheless improvements that can be made. For example, such solutions, under certain circumstances during dispensing can be in such a position that the vacuum has sealed off the spout stopping further dispensing. In other situations, the connector used between the spout body and the plug can apply forces onto the plug that can inadvertently dislodge the plug from the probe during use.

SUMMARY OF THE DISCLOSURE

The disclosure is directed, in one aspect to a dispensing system for a flexible bag comprising a spout. The spout includes a body, a plug and a first and second flexible coupling. The body is sealable to the flexible bag. The body includes a central bore extending therethrough, with a lower ring wall at a lower end thereof. The plug has a cavity and plug ring wall. The plug ring wall is attachable to the lower ring wall in sealed engagement. The first flexible coupling and the second flexible coupling each being formed from a base web and extending from the lower end of the body. A first arm is coupled to the base web at a first hinge. A second arm is coupled to the first arm opposite the base web at a central hinge. The plug is coupled to the second arm opposite the first arm at a plug hinge.

In some configurations, the plug is positionable between a first closed position and a second open position. In the closed position, each of the first arm and the second arm are oblique to each other. Each of the body hinge, the central hinge and the plug hinge are articulated in such a configuration.

In some configurations, the base web comprises a right triangle terminating at a distal end proximate the body hinge and the first arm.

In some configurations, in the second open position, the first arm of the first flexible coupling is parallel to the first arm of the second flexible coupling.

In some configurations, at least one of the first arm and the second arm of at least one of the flexible couplings further includes opposing protrusions extending from at least one side thereof, the opposing protrusions defining a flow channel.

In some configurations, each of the second arms of each of the flexible couplings include opposing protrusions extending from opposing sides thereof.

In some configurations, the plug is defined by an upstanding side, with at least one outer rib extending longitudinally along an outer surface of the upstanding side.

In some configurations, the upstanding side terminates at a circumferential rib. The circumferential rib includes at least one traversing channel positioned to correspond to the at least one outer rib.

In some configurations, the at least one outer rib comprises at least four outer ribs that are spaced apart from each other about the outer surface of the upstanding side.

In some configurations, the plug hinge of the first flexible coupling and the second flexible coupling couples the circumferential rim to the respective one of the second arms.

In some configurations, at least one rib terminates proximate the plug hinge of each of the first flexible coupling and the second flexible coupling.

In some configurations, the plug ring wall further includes an outer sealing rim extending therearound. At least one ring wall slot is in the plug ring wall between the sealing rim and an upper end face of the plug ring wall.

In some configurations, the at least one ring wall slot further comprises a pair of opposing ring slots.

In some configurations, a plane that is defined by the pair of opposing ring slots is perpendicular to a plane defined by the first and second flexible couplings.

In some configurations, a probe insertable thorough the central bore and releasably attachable to the plug.

In some configurations, the probe further includes a cavity body. The cavity body terminating at a conical lower end. The cavity body has a volume that is smaller than the cavity of the plug, so that when the cavity body is inserted into the cavity of the plug, a volume remains at a lower end thereof, as the cavity body is spaced apart from a lower end wall of the plug.

In another aspect of the disclosure, the disclosure is directed to a spout. The spout includes a body, a plug and a first and second flexible coupling. The body is sealable to the flexible bag. The body includes a central bore extending therethrough, with a lower ring wall at a lower end thereof. The plug has a cavity and plug ring wall. The plug ring wall is attachable to the lower ring wall in sealed engagement. The first flexible coupling and the second flexible coupling each being formed from a base web and extending from the lower end of the body. A first arm is coupled to the base web at a first hinge. A second arm is coupled to the first arm opposite the base web at a central hinge. The plug is coupled to the second arm opposite the first arm at a plug hinge.

In yet another aspect of the disclosure, the disclosure is directed to a flexible bag assembly, the flexible bag assembly includes a flexible bag and a spout. The flexible bag is defined by a first panel and a second panel with a plurality of seals coupling the first and second panels to form a cavity. The spout includes a body, a plug and a first and second flexible coupling. The body is sealable to the flexible bag. The body includes a central bore extending therethrough, with a lower ring wall at a lower end thereof. The plug has a cavity and plug ring wall. The plug ring wall is attachable to the lower ring wall in sealed engagement. The first flexible coupling and the second flexible coupling each being formed from a base web and extending from the lower end of the body. A first arm is coupled to the base web at a first hinge. A second arm is coupled to the first arm opposite the base web at a central hinge. The plug is coupled to the second arm opposite the first arm at a plug hinge.

In some configurations, a probe is insertable thorough the central bore and releasably attachable to the plug.

Methods of dispensing or filling with a probe are likewise disclosed as other aspects of the present disclosure.

BRIEF DESCRIPTION OF THE DRAWINGS

The disclosure will now be described with reference to the drawings wherein.

DETAILED DESCRIPTION OF THE DISCLOSURE

Figure 1:
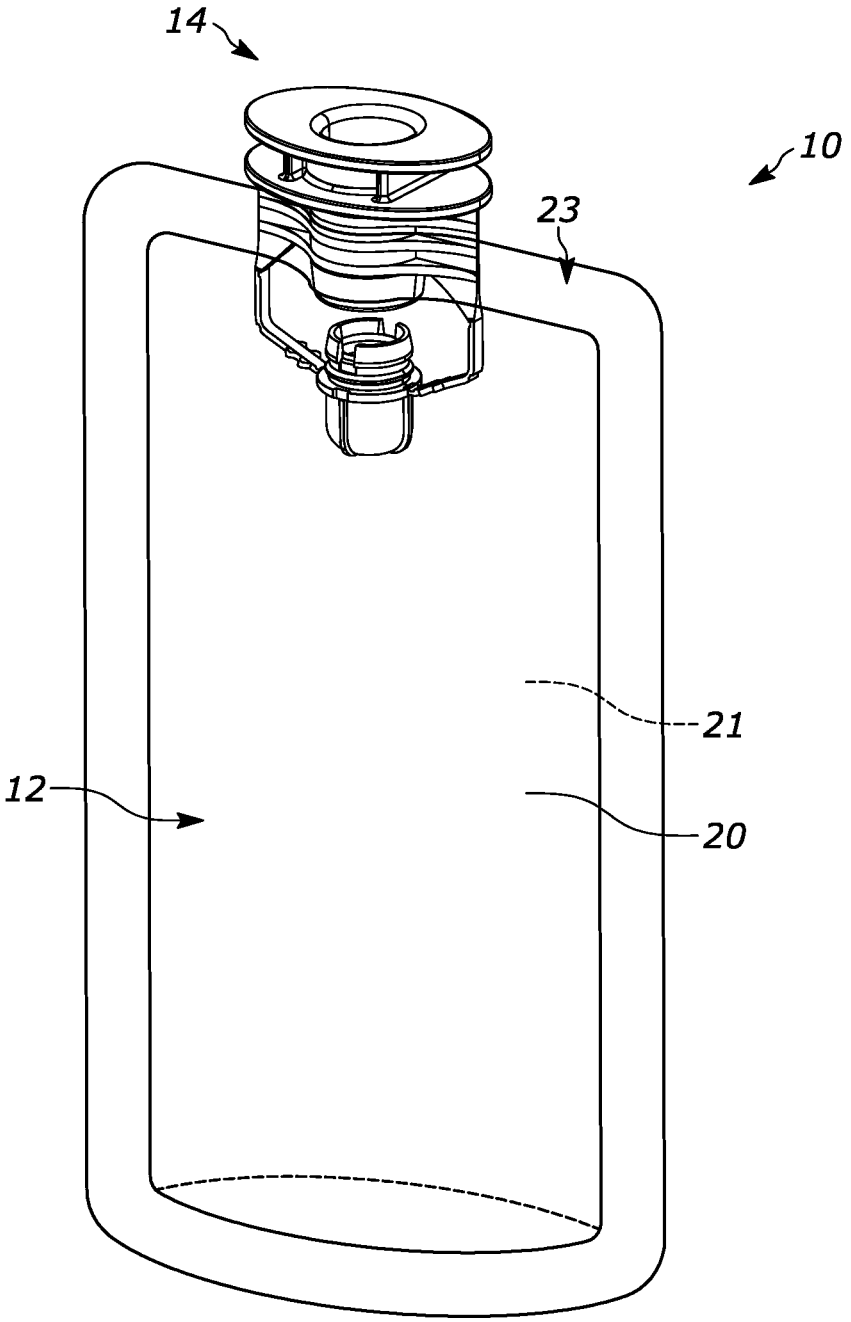
FIG. 1 of the drawings is a perspective view of a flexible bag assembly of the present disclosure.

While this disclosure is susceptible of embodiment in many different forms, there is shown in the drawings and described herein in detail a specific embodiment(s) with the understanding that the present disclosure is to be considered as an exemplification and is not intended to be limited to the embodiment(s) illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the flexible bag assembly is shown generally at 10. The flexible bag assembly includes a bag 12 and spout 14. The bag 12 may comprise a flexible bag of a number of different sizes and configurations. In the configuration shown, the flexible bag comprises a pouch (typically, sized up to 2.5 liters, while other sizes are contemplated). The flexible bag is configured to provide a fluid tight configuration that can receive and dispense a flowable material, such as liquids, syrups, suspensions, emulsions, purees, foodstuffs, oils, drinks, condiments, spices, among others. There is no limitation on the particular flowable material that can be placed within the flexible bag.

The flexible bag 12 includes a first panel 20 and a second panel 21 that are attached together through a plurality of seals 23. In some configurations, the flexible bag may be gusseted, where additional panels are utilized and sealed together so as to form a fluid tight cavity. The flexible bag panels may be made from any number of different materials, including but not limited to laminated and/or co-extruded polymer based films, biofilms, single material film which may be coated or metallized. The seals may be formed through heat sealing, RF welding, IR welding, adhesion, among others. In the configuration shown, the plug is configured for a fin seal. It is contemplated that in other configurations, the plug may be coupled to a single wall of the flexible bag, instead of being sandwiched between two opposing panels and formed into the seal therebetween.

Spout 14 (often referred to as the female member of the spout and plug dispensing system of the present disclosure) is shown in FIGS. 3 through 6 as including body 24, plug 26 and opposing flexible couplings 28, 28'. In the configuration shown, the spout is an integrally molded from a polymer, such as a polyethylene material (while not limited thereto).

The body 24 includes first fin surface 30 and second fin surface 32 opposite the first fin surface. As is understood by one of skill in the art, such fin surfaces are mated to the panels and form a portion of the seals 23 that provide the fluid tight cavity of the flexible bag. In the configuration shown, each of the fin surfaces has three parallel and spaced apart fin seal flanges that are sealed to the seals 23. The body of the spout is defined by an upper surface 34 and a lower end 36 with a central bore 40 extending therethrough. Opposing transverse channels 38 can be formed proximate the upper surface to facilitate retention in a channel of a frame or holder that is interfaced with a filler. The channels 38 are generally parallel to the upper surface 34 and/or perpendicular to a central axis of the central bore 40, and positioned on opposing sides of the central bore 40.

The central bore 40 is defined by inner surface 46 that extends from first end 42 and to second end 44. Proximate the second end is lower ring wall 48 which forms the termination of the central bore 40. The lower ring wall 48 includes outer surface 50, inner surface 52 and axial end fact 54. The inner surface 52 includes an upper seat surface 56 and shoulder surface 58. The upper seat surface 56 is inwardly angled so that in cross-section, the diameter is reduced away from the axial end face 54, with the shoulder surface forming an outward flange from the end of the upper seat surface outwardly.

Figure 4:
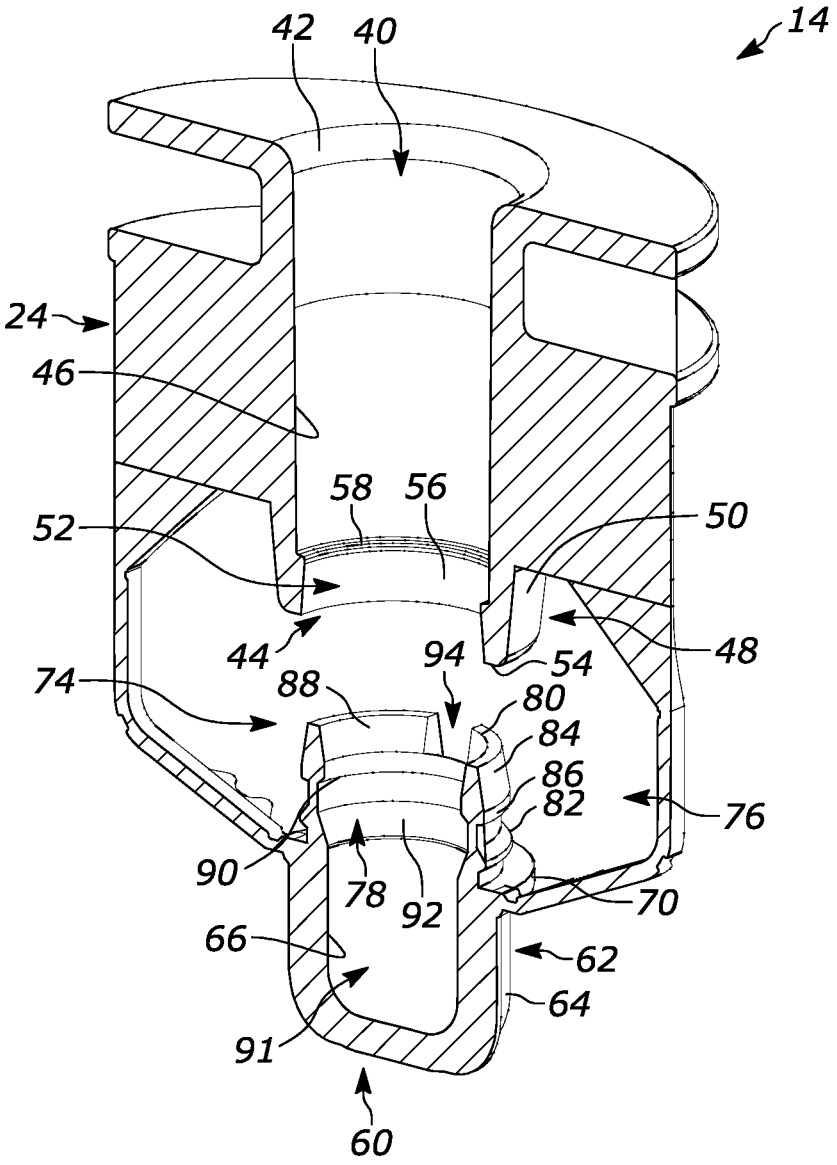
FIG. 4 of the drawings is a perspective cross-sectional view of the spout of the flexible bag assembly of the present disclosure.
Figure 5:
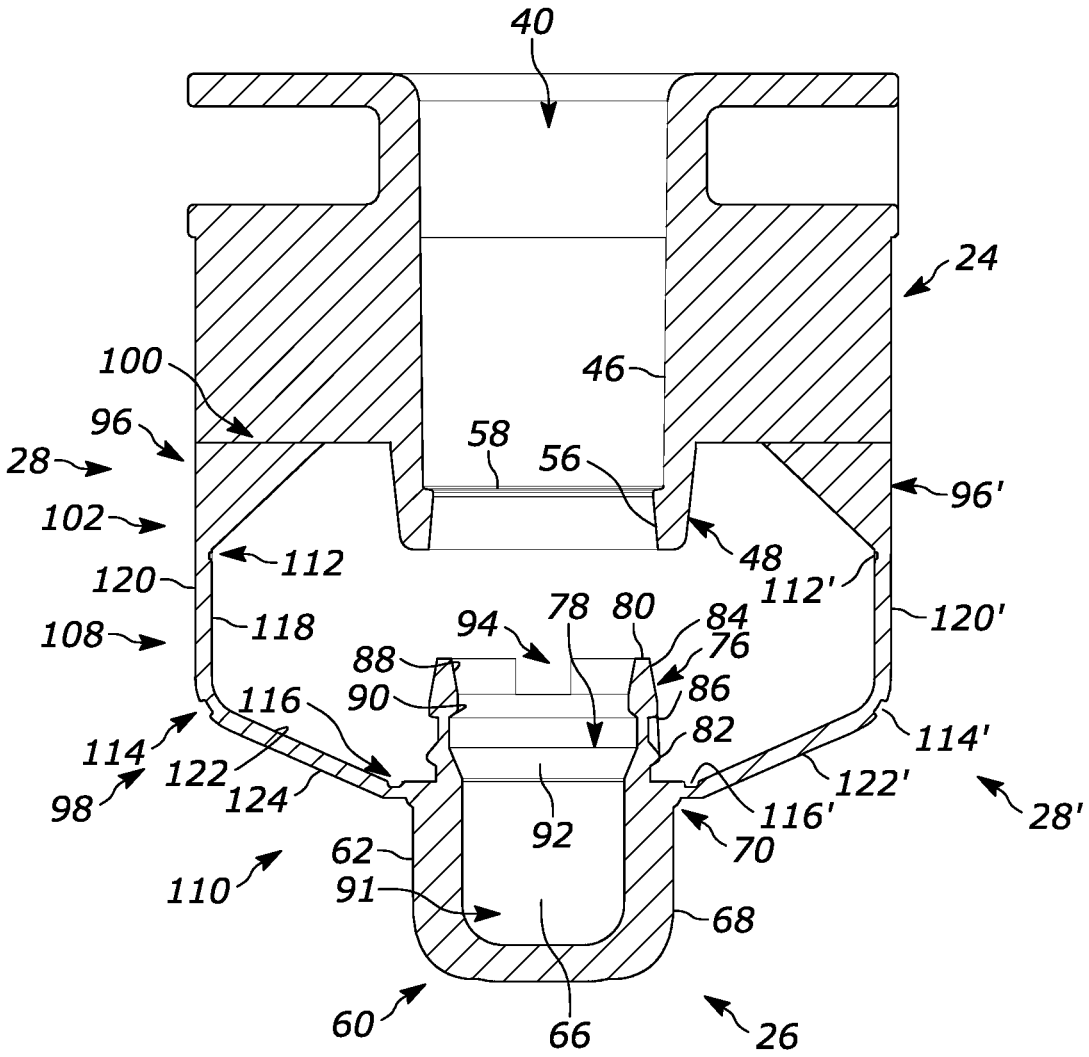
FIG. 5 of the drawing is a cross-sectional view of the spout of the flexible bag assembly of the present disclosure.
Figure 6:
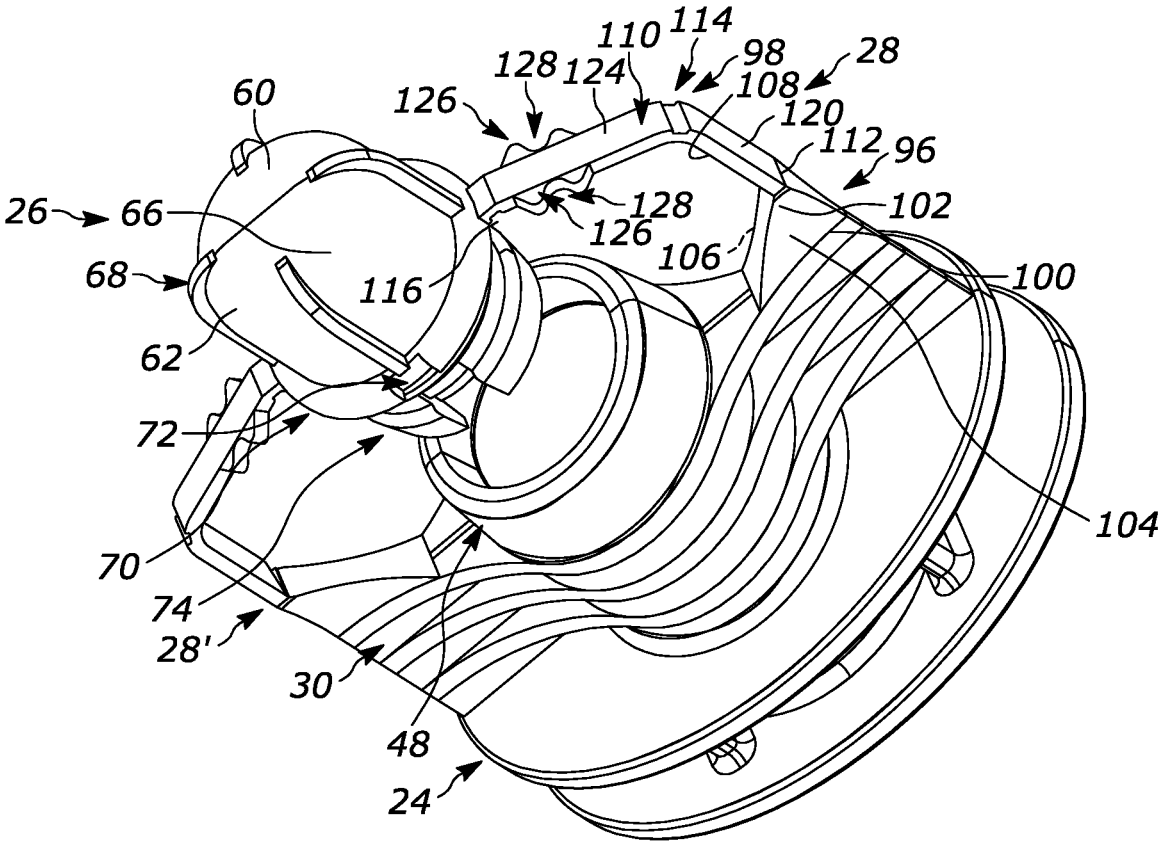
FIG. 6 of the drawings is a bottom perspective view of the spout of the flexible bag assembly of the present disclosure.

The plug 26 is shown in FIGS. 4 through 6 as comprising lower end wall 60, upstanding sides 62, circumferential rim 70 and plug ring wall 74. The end wall and the upstanding sides define cavity 91. The upstanding sides 62, which in the configuration shown, defines a cylindrical configuration, include outer surface 64 and inner surface 66. A plurality of outer ribs 68 extend longitudinally don the side of the outer surface 64 and taper while extending radially inwardly at the lower end wall 60. In the configuration shown, four outer ribs are shown in a space apart configuration about the outer surface of the upstanding sides (and taper toward each other radially inwardly at the lower end wall). Additionally, in the configuration shown, a pair of outer ribs align with the first and second flexible couplings 28, 28' with a pair of outer ribs being 90° spaced apart therefrom and being generally perpendicular to a plane bisecting the first and second fin surfaces. In other configurations, a greater or lesser number of ribs may be contemplated, and in various different configurations.

In the configuration shown, the outer ribs terminate at the circumferential rim 70. In the configuration shown, additionally, the traversing channel 72 aligns on opposing sides with a corresponding rib of the outer ribs.

The plug ring wall 74 is shown as including an outer surface 76 and an inner surface 78, terminating at an upper end face 80. The plug ring wall is structurally configured to both sealingly engage with the lower ring wall and also engage with a probe, such as probe 16. The outer surface of the plug ring wall 74 further includes an outer sealing rim 82, along with an outer seat surface 84 and outer hook surface 86. The outer seat surface angles outwardly away from the upper end face 80 terminating in the hook surface 86 which is inwardly directed at the end of the outer seat surface. The outer sealing rim is spaced apart from the hook surface 86.

The inner surface 78 of the plug ring wall 74 includes inner seat surface 88, inner shoulder 90 and inner guide surface 92. The inner seat surface 88 is angled inwardly away from the upper end face 80. The inner shoulder 90 is positioned at the end of the inner seat surface and extends outwardly therefrom. The inner guide surface is angled inwardly toward lower end wall to provide both a narrowing of the cavity 91 and also to guide the probe further into the cavity 91. A pair of opposing ring wall slots 94 extend on opposite sides of the plug ring wall and bisect the ring wall into two arcuate configurations. The pair of opposing ring wall slots are positioned so as to define a plane that extends through the central bore and that also bisects the first and second fin surfaces (being perpendicular to the a plane extending between the fin surfaces).

The first and second flexible couplings 28, 28' extend from opposing sides of the lower end 36 of the body 24 of the spout 14 and to the plug 26 to join the plug 26 with the body 24 of the spout. The flexible couplings are in a plane that bisects the central bore between the first and second fin surfaces 30, 32, while other configurations are contemplated. The first flexible coupling 28 will be described in detail with the understanding that the second flexible coupling 28' is substantially a mirror image thereof.

The flexible coupling 28 includes base web 96 and arm assembly 98. The base web has a proximal end 100 and a distal end 102, with opposing sides, first side 104 and second side 106. The base web extends from the lower end 36 of the body 24. In the configuration shown, the base web defines a right triangle having an oblique side extending outwardly from the lower end of the body 24. The arm assembly 98 includes first arm 108 and second arm 110. The first arm 108 includes an inner surface 118 and an outer surface 120. The second arm includes an inner surface 122 and an outer surface 124. The first arm extends from the distal end 102 of the base web 96 to the second arm 110. The second arm extends to the plug 26, and attaches thereto proximate the circumferential rim 70.

The first arm is attached to the distal end 102 of the base web with body hinge 112 which comprises a notch on the inner surface of 118 of the first arm. The first and second arms are joined together at central hinge 114, which comprises a notch on the outer surfaces 120, 124 of the first and second arms. The second arm 110 is joined to the circumferential rim 70 at plug hinge 116, which comprises a notch on the inner surface 122 of the second arm 110.

Opposing protrusions 126 are defined as extending from either side of the second arm 110. These opposing protrusions define flow channels 128 therebetween. In the configuration shown, the each side has two protrusion, defining a flow channel therebetween. And, each of the opposing protrusions are substantially uniform and mirror images of each other on the opposing sides, while variations are contemplated. The opposing protrusion comprise a pair of side by side spaced apart undulations or waves defined by peaks with curved surfaces on either side thereof. The opposing protrusions may be on only one side of either one or both of the first arm and the second arm, or on both sides of either one or both of the first arm and the second arm. In the configuration shown, opposing protrusions are on either side of the second arms of both of the flexible couplings. It is also contemplated that only one of the flexible couplings may include opposing protrusions.

Figure 2:
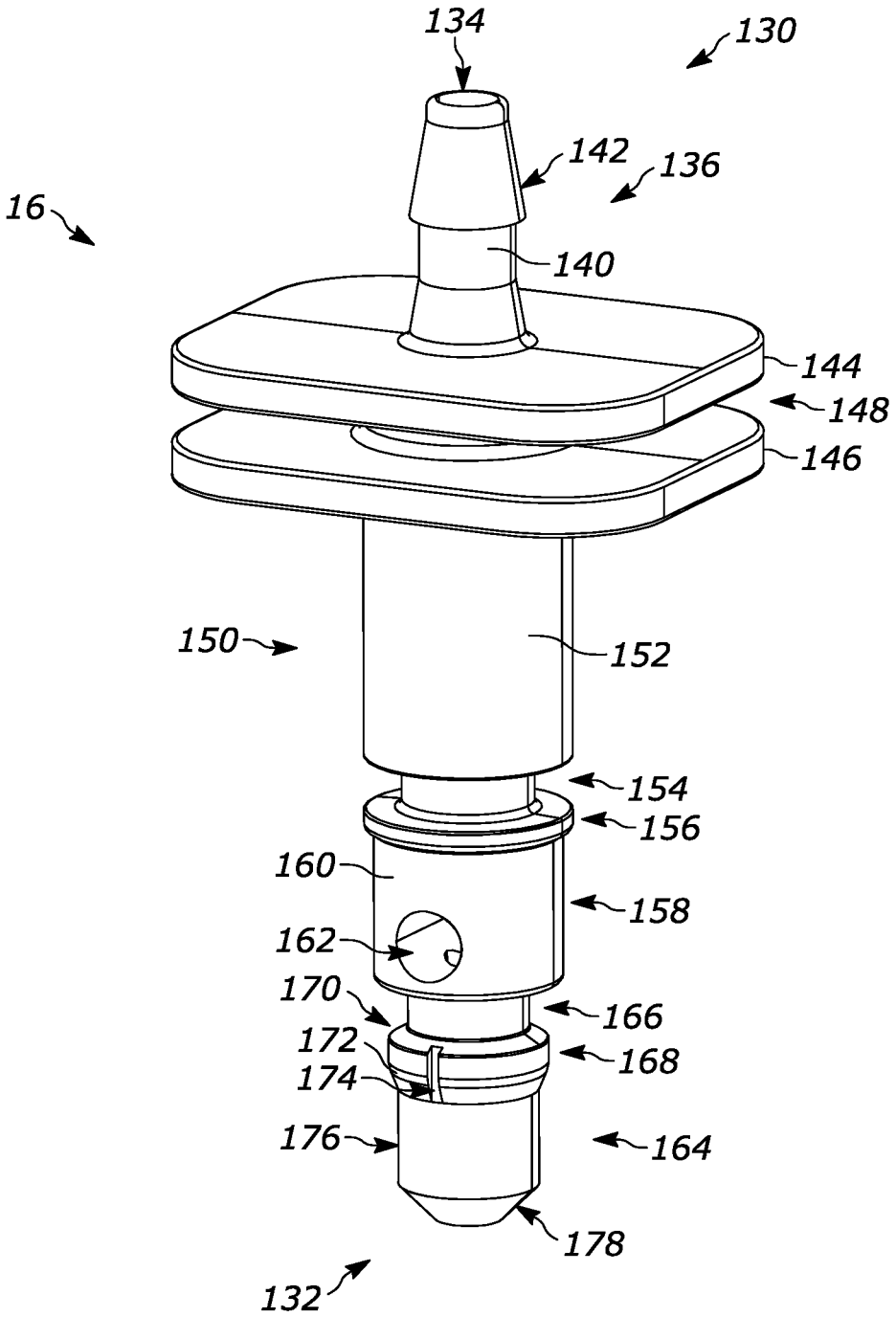
FIG. 2 of the drawings is a perspective view of a probe for use with the spout and the flexible bag of the present disclosure.
Figure 3:
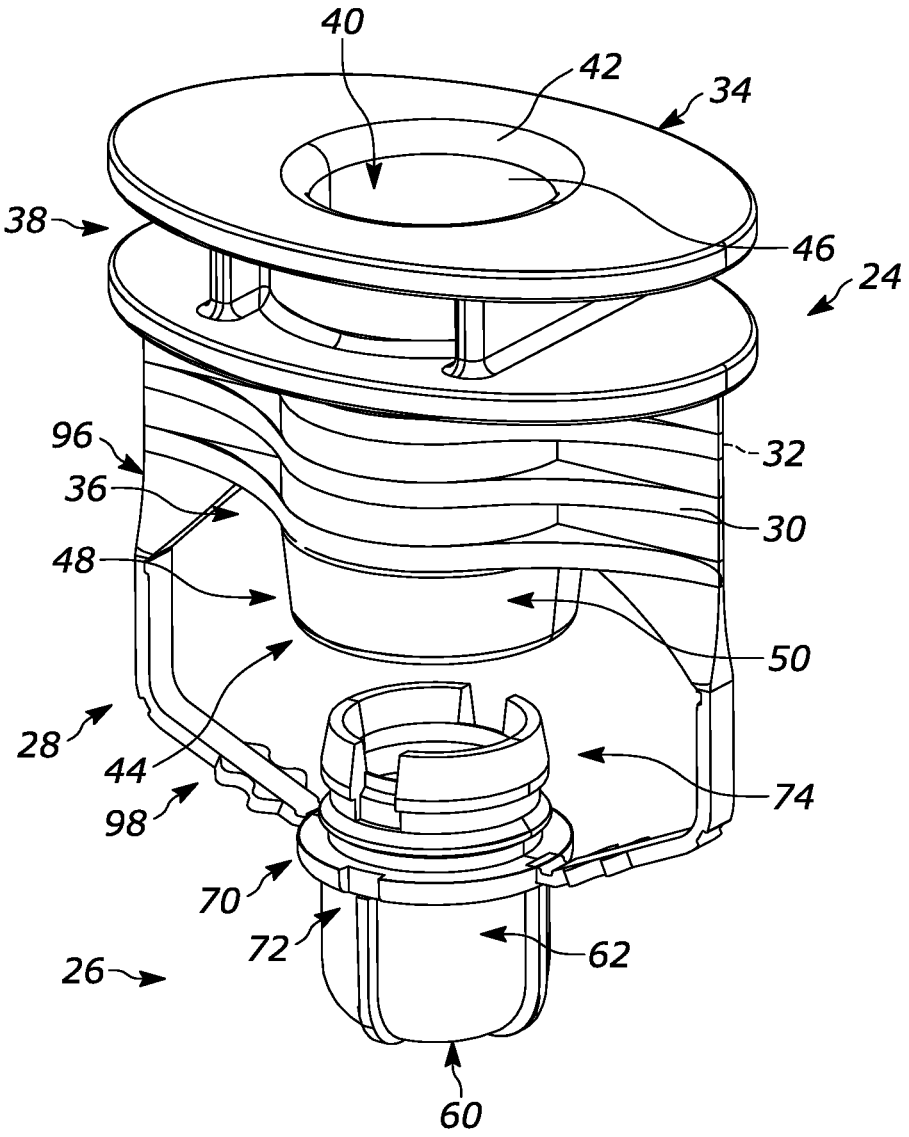
FIG. 3 of the drawings is a perspective view of a spout of the flexible bag assembly of the present disclosure.

Probe 16 is shown in FIG. 2 as extending between proximal end 130 and distal end 132. A probe bore 134 extends through the probe 16. A ring projection 144 and stop ridge 146, each of which comprise substantially planar surfaces, are spaced apart from each other to form slot 148. The ring projection and the stop ridge separate the probe into an upper part and a lower part. The upper part comprises the hose coupling portion 136. The hose coupling portion 136 includes outer surface 140 and barb 142. The hose coupling portion is configured to sealingly engage a hose that is coupled thereto.

The lower part of the probe 16 includes upper insertion body portion 150, dispensing body portion 158 and head portion 164. The upper insertion body portion 150 includes outer surface 152, and at a lower end thereof, a groove 154 with a stop flange 156. The outer surface is substantially cylindrical, with the stop flange 156 may axially outwardly from the outer surface 152.

The dispensing body portion 158 depends from the stop flange 156 and defines an outer surface 160 that is axially inward of the stop flange 156 (i.e., a smaller diameter than the stop flange. Additionally, the dispensing body portion 158 includes a cross passage 162 that is generally perpendicular to the probe bore 134 and through the outer surface 160.

The head portion 164 includes circumferential groove 166, locking rim 168 and cavity body 176. The circumferential groove 166 is positioned below the dispensing body portion. The locking rim 168 defines an upper shoulder 170, an interfacing surface 172 and drain passages 174. The upper shoulder spans between the circumferential groove and the interfacing surface 172. The drain passages 178 are defined in the interfacing surface and the upper shoulder and are generally parallel to a longitudinal axis of the probe bore 134.

The cavity body 176 includes a conical lower end 178, which in the configuration shown, comprises a frusto-conical configuration. As will be explained, the cavity body is configured to extend into the cavity of the plug. It is contemplated that if the probe is configured to fill the flexible bag, the cavity body may substantially match the configuration of the cavity 91. Whereas where the probe is used to dispense flowable material from within the flexible bag, then the cavity body of the probe may be smaller than that of the cavity.

Figure 8B:
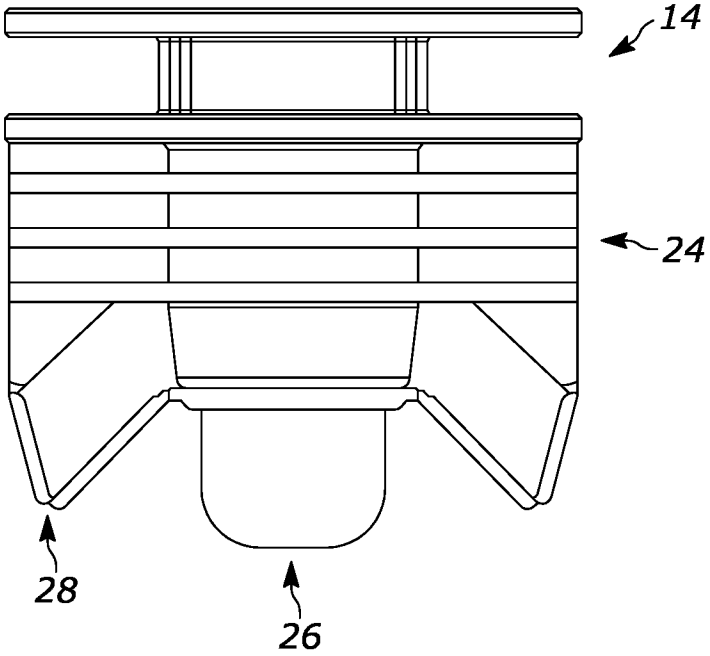
FIG. 8*b* of the drawings is a side elevational view of the spout in a first closed configuration.
Figure 8A:
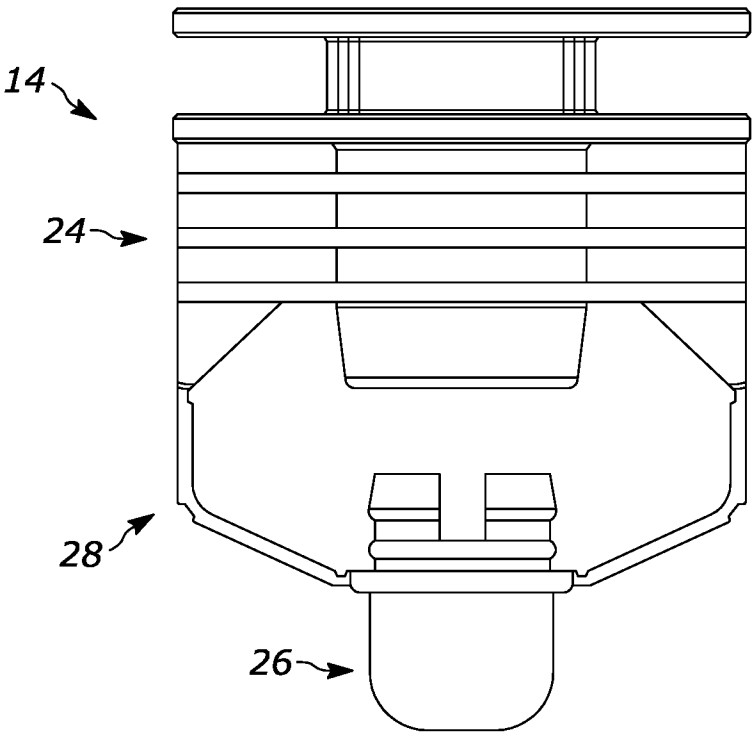
FIG. 8*a* of the drawings is a side elevational view of the spout in a second open configuration.

In operation, it will be understood that the plug can be in at least different positions (as is shown in FIGS. 8*a* and 8*b*), an open position, wherein the plug 26 is separated from the lower ring wall 48, and a closed position, wherein the plug is releasably and sealingly attached to the lower ring wall 48. When in the open position, the plug is spaced apart from the body and is maintained in such a separated orientation by the flexible couplings 28, 28'. In the closed position, the plug and the body are fully and sealingly engaged so that the plug provides a seal for the central bore at the lower end thereof.

In the open position, preferably, the first arm 108 and 108', of each of the arm assemblies of the flexible couplings 28, 28' are substantially parallel to each other, with the second arms oblique thereto. In the closed configuration, articulation of each of the body hinge, central hinge and plug hinge places the first and second arms oblique to each other and oblique to a longitudinal axis of the central bore.

In the closed position, the outer hook surface 86 of the plug engages against the shoulder surface 58 of the body 24 to releasably lock the plug to the body. Additionally, in the closed position, the outer sealing rim 82 seals against the upper seat surface 56 of the lower ring wall 48.

Figure 7B:
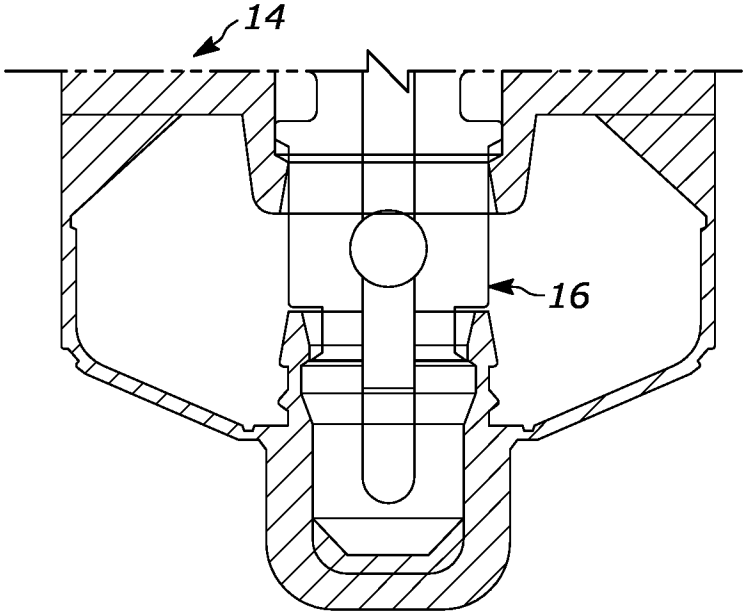
FIG. 7*b* of the drawings is a cross-sectional view of the probe inserted into the spout so as to be configured for dispensing from the flexible bag therethrough.

When the probe, such as probe 16 is inserted into the central bore 40, the probe is directed into contact with the plug 26. In particular, the cavity body 176 of the probe is directed into the cavity 91. As the probe continues, the interfacing surface 172 pushes against the inner seat surface 88 of the probe directing the seat surface outwardly so as to engagement is maintained between the outer hook surface 86 of the plug 26 and the shoulder surface 58 of the body. Continued movement of the probe in the insertive direction eventually directs the probe beyond the inner shoulder 90 of the plug ring wall so that the upper shoulder 170 of the head portion of the probe lockingly engages the same. In the event that there is flowable material that remained within the cavity of the plug, the insertion of the probe can direct the flowable material through the drain passages 174 and out of the cavity. In the instance of a dispensing probe (as is shown in FIG. 7*b*), the cavity body is smaller in volume and shape than the cavity of the plug so as to allow for some space for fluid proximate the lower end wall of the plug within the cavity.

Figure 7A:
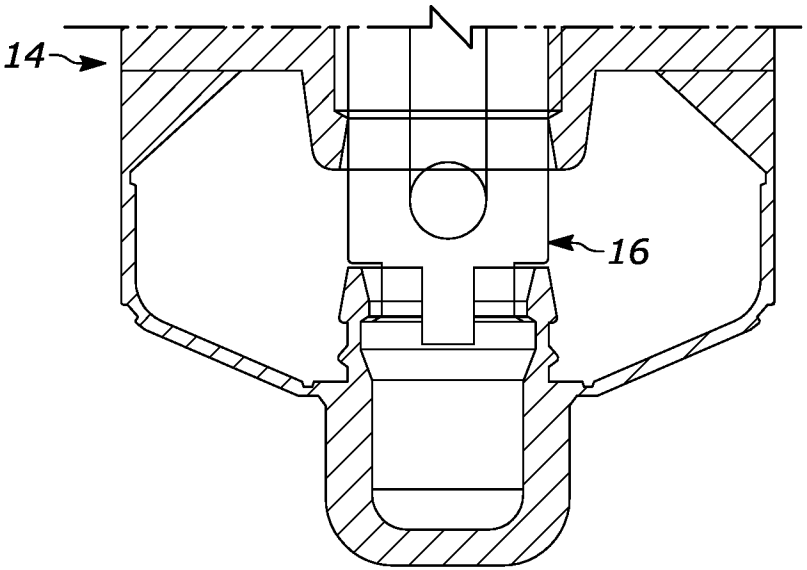
FIG. 7*a* of the drawings is a cross-sectional view of the probe inserted into the spout so as to be configured for filling of the flexible bag therethrough.

Once engaged, the further insertion pushes the plug away from the spout. Initially, such insertion directs the outer seat surface inwardly until the outer hook surface 86 is sufficiently moved away from the shoulder surface 58 (and toward and into the circumferential groove 166) so that the plug can be directed out of the central bore of the body of the spout. Additionally, such inward movement is facilitated by the ring wall slots 94 which slots allow for the inward movement of the upper portions of the plug ring wall, and reduce the force necessary to separate the plug from the body of the spout by the probe. Such a configuration in shown in FIGS. 7*a* (for a fill probe) and 7*b* (for a dispensing probe).

Further insertion directs the plug away (which plug movement is controlled by the probe in conjunction with the first and second flexible couplings) from the body of the spout. Eventually, the stop flange 156 interfaces with the shoulder surface 58 of the central bore 40 to preclude further insertive movement of the probe. Flowable material can then be either directed into the flexible package or out of the flexible package through the cross passage 162 and the probe bore 134.

Advantageously, with the three separate hinges of each of the arm assemblies, the arm assemblies provides a controlled movement and deflection of the arms while in the closed position or in the open position, and biasing forces of the arm to direct the plug into or out of the closed position can be minimized. Thus, control of the plug can be maintained, without applying a strong biasing force thereagainst.

Where fluid is being directed out of the flexible package, there is a tendency for the package to be pulled against both itself and the surfaces of the body, the flexible coupling and the plug. The outer ribs 68 of the plug, in combination with the traversing channel 72 of the circumferential rim maintain fluid passage ways and precluding the choking off of the flow out of the flexible package due to vacuum forces. Additionally, and similarly, the configuration of the opposing protrusions 126, 126' on each of the second arms of the flexible couplings maintain an open flow channel 128, 128' under such vacuum conditions.

When completed, it is desirable to remove the probe from within the flexible bag and also from within the spout. To achieve the same, the probe is retracted from within the central bore. Initial movement pulls the plug back toward and into contact with the lower ring wall 48 of the body 24 of the spout. The three hinges and two arms of each of the arm assemblies facilitate articulation at all three hinges to minimize the biasing force exerted onto the plug, to, in turn, minimize the ability of such biasing force to dislodge the plug from the probe.

Continued retractive movement of the probe directs the outer seat surface 84 against the upper seat surface 56 and inwardly directs the outer seat surface of the probe. This inward movement maintains the probe within the cavity of the plug while the plug is being inserted into the central bore. Eventually, the outer hook surface 86 engages the shoulder surface 58 locking the plug to the body. Such insertion also moved the outer sealing rim 82 of the plug into the central bore sealing the central bore from the flexible bag cavity (in a fluid tight, and hermetic seal).

Further retractive movement directs the outer seat surface outwardly so that the upper shoulder 170 of the head portion of probe 16 can be directed beyond the inner shoulder 90 of the plug releasing the probe from the plug, and allowing further and full removal of the probe from within the central bore.

The foregoing description merely explains and illustrates the disclosure and the disclosure is not limited thereto except insofar as the appended claims are so limited, as those skilled in the art who have the disclosure before them will be able to make modifications without departing from the scope of the disclosure.

What is claimed is:

1. A dispensing system for a flexible bag comprising:

a spout having:

a body sealable to the flexible bag, the body including a central bore extending therethrough, with a lower ring wall at a lower end thereof;

a plug having a cavity, with a plug ring wall, the plug ring wall attachable to the lower ring wall in sealed engagement; and a first flexible coupling and a second flexible coupling, the first and second flexible couplings are each formed from a base web extending from the lower end of the body, a first arm coupled to the base web at a first hinge, a second arm coupled to the first arm opposite the base web at a central hinge and wherein the plug is coupled to the second arm opposite the first arm at a plug hinge, each second arm includes an inner surface and an outer surface opposite the inner surface, with opposing sides spanning therebetween, each opposing side having a plurality of protrusions extending therefrom so as to define a flow channel therebetween that is spaced apart from the plug hinge and the central hinge.

2. The dispensing system of claim 1 wherein the plug is positionable between a first closed position and a second open position, wherein in the closed position, each of the first arm and the second arm are oblique to each other and wherein each of the body hinge, the central hinge and the plug hinge are articulated.

3. The dispensing system of claim 2 wherein the base web comprises a right triangle terminating at a distal end proximate the body hinge and the first arm.

4. The dispensing system of claim 2 wherein, in the second open position, the first arm of the first flexible coupling is parallel to the first arm of the second flexible coupling.

5. The dispensing system of claim 1 wherein the plug is defined by an upstanding side, with at least one outer rib extending longitudinally along an outer surface of the upstanding side.

6. The dispensing system of claim 5 wherein the upstanding side terminates at a circumferential rib, with the circumferential rib including at least one traversing channel positioned to correspond to the at least one outer rib.

7. The dispensing system of claim 5 wherein the at least one outer rib comprises at least four outer ribs that are spaced apart from each other about the outer surface of the upstanding side.

8. The dispensing system of claim 5 wherein the plug hinge of the first flexible coupling and the second flexible coupling couples the circumferential rim to the respective one of the second arms.

9. The dispensing system of claim 8 wherein at least one rib terminates proximate the plug hinge of each of the first flexible coupling and the second flexible coupling.

10. The dispensing system of claim 1 wherein the plug ring wall further includes an outer sealing rim extending therearound, with at least one ring wall slot in the plug ring wall between the sealing rim and an upper end face of the plug ring wall.

11. The dispensing system of claim 10 wherein the at least one ring wall slot further comprises a pair of opposing ring slots.

12. The dispensing system of claim 1 wherein a plane that is defined by the pair of opposing ring slots is perpendicular to a plane defined by the first and second flexible couplings.

13. The dispensing system of claim 1 further comprising a probe insertable thorough the central bore and releasably attachable to the plug.

14. The dispensing system of claim 13 wherein the probe further includes a cavity body, the cavity body terminating at a conical lower end, with the cavity body having a volume that is smaller than the cavity of the plug, so that when the cavity body is inserted into the cavity of the plug, a volume remains at a lower end thereof, as the cavity body is spaced apart from a lower end wall of the plug.

15. A spout having:

a body sealable to a flexible bag, the body including a central bore extending therethrough, with a lower ring wall at a lower end thereof;

a plug having a cavity, with a plug ring wall, the plug ring wall attachable to the lower ring wall in sealed engagement; and a first flexible coupling and a second flexible coupling, the first and second flexible couplings are each formed from a base web extending from the lower end of the body, a first arm coupled to the base web at a first hinge, a second arm coupled to the first arm opposite the base web at a central hinge and wherein the plug is coupled to the second arm opposite the first arm at a plug hinge, each second arm includes an inner surface and an outer surface opposite the inner surface, with opposing sides spanning therebetween, each opposing side having a plurality of protrusions extending therefrom so as to define a flow channel therebetween that is spaced apart from the plug hinge and the central hinge.

16. A flexible bag assembly comprising:

a flexible bag defined by a first panel and a second panel with a plurality of seals coupling the first and second panels to form a cavity;

a spout attachable to the flexible bag in sealed engagement, the spout providing selective fluid communication with the cavity of the flexible bag, the spout further comprising:

a body sealable to the flexible bag, the body including a central bore extending therethrough, with a lower ring wall at a lower end thereof;

a plug having a cavity, with a plug ring wall, the plug ring wall attachable to the lower ring wall in sealed engagement; and a first flexible coupling and a second flexible coupling, the first and second flexible couplings are being formed from a base web extending from the lower end of the body, a first arm coupled to the base web at a first hinge, a second arm coupled to the first arm opposite the base web at a central hinge and wherein the plug is coupled to the second arm opposite the first arm at a plug hinge, each second arm includes an inner surface and an outer surface opposite the inner surface, with opposing sides spanning therebetween, each opposing side having a plurality of protrusions extending therefrom so as to define a flow channel therebetween that is spaced apart from the plug hinge and the central hinge.

17. The dispensing system of claim 16 further comprising a probe insertable thorough the central bore and releasably attachable to the plug.

* * * * *